US005089414A

United States Patent [19]

Christner et al.

[11] Patent Number: 5,089,414

[45] Date of Patent: Feb. 18, 1992

[54] ENZYMATIC SOAKING METHOD

[75] Inventors: Juergen Christner, Seeheim-Jugenheim; Ernst Pfleiderer, Darmstadt; Tilman Taeger, Seeheim-Jugenheim, all of Fed. Rep. of Germany

[73] Assignee: Röhm GmbH, Darmstadt, Fed. Rep. of Germany

[21] Appl. No.: 528,717

[22] Filed: May 24, 1990

[30] Foreign Application Priority Data

Jul. 11, 1989 [DE] Fed. Rep. of Germany ..... 3922748

[51] Int. Cl.[5] ..... C14C 1/04

[52] U.S. Cl. ..... 435/265; 435/198; 435/267; 424/94.6

[58] Field of Search ..... 424/94.6; 435/198, 265; 252/8.57; 8/94.15, 94.18

[56] References Cited

U.S. PATENT DOCUMENTS 4,943,530 7/1990 Christner et al. ..... 435/198
4,968,621 11/1990 Pfleiderer et al. ..... 435/265

FOREIGN PATENT DOCUMENTS 0941811 4/1956 Fed. Rep. of Germany .
3312840 10/1984 Fed. Rep. of Germany .

*Primary Examiner*—Douglas W. Robinson
*Assistant Examiner*—Jean C. Witz

[57] ABSTRACT

The soaking of hides and skins is enzymatically assisted in a method using an aqueous float having a pH from 9 to 11 which contains A) a lipase having an activity optimum in the pH region from 9 to 11, B) a protease with activity in the pH region from 9 to 11, and C) a surface active agent.

4 Claims, No Drawings

ENZYMATIC SOAKING METHOD

The present invention relates to a method for the soaking of salted, dried, and fresh hides with enzyme products containing an alkaline lipase.

An important operational step right at the beginning of beamhouse operations is the soaking of hides and skins. The soaking serves to clean adhering dirt from the raw hide, to remove curing salt and other preserving agents from the hide, to dissolve out water soluble protein components at least partially, and to return the hide to the degree of swelling which it had in its original condition and which was lost in the course of the curing process. (Cf. H. J. Rehm and G. Reed, Biotechnology, Vol. 6b, p 734–735, Verlag Chemie, Weinheim 1988).

As soaking auxiliaries, today predominantly surface active agents and defatting agents, as well as proteolytic enzymes, are added. In this way, adhering dirt and natural fat are removed with the result that the rehydration and fiber separation is accelerated. The soaking process is preferably carried out at pH 9–10.

This procedure has the advantage that the pH change to the following liming is kept small and that bacterial growth is suppressed. Exactly with fatty raw materials has it proved that the soaking process and the subsequent opening-up of the grain always presupposes a very good defatting (U.S. Pat. No. 4,344,72; DE-OS 33 12 840). Therefore, lipases are also added as well as special emulsifiers, as is evident from numerous literature sources (L. H. Posorske, J. Am Oil Chem. Soc. 61 (11), 1758 - 60 (1984). The use of lipases extends in this instance predominantly over a pH region of 6–9. Of course, the experience which has been acquired, for example in the field of laundry washing agents, opposes the industrial utilization of lipases. This experience has been summarized in the literature as follows: "However, it (i.e. lipase) cannot be applied as a detergent enzyme, because of its instability under alkaline conditions and its expensiveness" (cf. H. J. Rehm and G. Reed, Biotechnoloqy, Vol. 7a, p. 644, VCH 1987). The joint use of lipases and proteases is contradicted by the known degrading effect of the proteases toward lipases.

In the modern view the soak serves not only for cleaning, but also for the removal of components of the skin which could unfavorably influence subsequent operation, for example the skin fat. The enzymatically assisted soaking processes of the state of the art could be less than completely satisfactory from many viewpoints if lipases were used therewith. First, there is an unsatisfactory price-effect relationship in the use of lipases; further it is not uncommon that spots are formed in leather, caused by gypsum stains.

Thus, the problem arose of providing soaking processes which would avoid the disadvantages just described while providing the same soaking effect.

It has now been found that the soaking method according to the invention is very capable of solving the problem which is posed. The invention relates to a method for the enzymatically aided soaking of hides and skins in salted, dried, or fresh condition with the use of proteolytic and lipolytic enzymes as well as surface active agents in the aqueous float, wherein in addition to proteases with sufficient activity in the pH region from 9–11, lipolytic enzymes which are lipases having an activity optimum between pH 9 and 11 are added, and wherein the pH value of the soaking bath is in the region from 9–11, preferably 9.5–11.

The soaking floats of the invention having pH values around 9.5 thereby contain, in addition to (B) proteases having sufficient activity in the pH region between 9 and 11, also (A) lipases having an activity optimum in the pH region between 9 and 11, and (C) surface active agents such as emulsifiers and (D) optional sequestering agents.

In agreement with the usual definitions, the lipases to be used according to the invention are esterases which hydrolyze glycerine esters of the fatty acids in aqueous emulsion (E.C. 3.1.1.3.) Preferably, the cleavage of the triglycerides takes place in the 1,3-position. In contrast to the lipases used in the prior art having a region of use from pH 6–9, the lipases used according to the invention have a pronounced activity optimum (e.g. towards olive oil or tributyrin) between pH 9 and 11. Such kinds of alkaline lipases have been specially developed for the laundry detergent industry. They are of microbiological origin. Potential sources for such strains of microorganisms, which may be genetically modified, are particularly fungi and bacteria. Certain alkaline lipases are present, e.g., in Pseudomonas strains. Also, Rhizopus sp., Candida sp., and Chromobacterium sp. are possible lipases sources. Further important lipase producers are Geotrichium sp, Aspergillus ssp., Mucor sp., Penicillium sp., Corynebacterium sp., Propionibacterium sp., and Achromobacter sp. To be specially mentioned are *Rhizopus arrhizus* and *Rh. oryzae, Candida cylindracea, Chromobacterium viscosum, Geotrichium candidum, Mucor miehi, Mucor pusillus, Penicillium roqueforti*, and *P. cyclopium, CorYnebacterium acne, Propionibacterium shermanii, Achromobacter lipolyticum, Aspergillus niger*, and particularly *Aspergillus oryzae*. Certain genetically altered strains have been found particularly suitable, e.g. an alkaline lipase from an *Aspergillus oryzae* strain obtained by recombination having a pronounced activity optimum between pH 9 and 11 or a lipase commercially available under the trademark "LIPOLASE 30T" (Novo Industri A/S, DK 2880 Bagsvaerd, Denmark).

In conventional fashion, determination of the activity of lipases is carried out with olive oil as a substrate, also with triacetin and tributyrin. [Cf. M. Sémériva et al., Biochemistry 10, 2143 (1970); *Pharmaceutical Enzymes*, edited by R. Ruyssen and A. Lauwers 1978, (E. Story-Scientia P.V.B.A. Scientific Publishers, Ghent)].

To the extent that the fat cleaving activity is expressed in kilo-lipase units (unit is the KLCA), tributyrin is used as the substrate under the standard conditions of 40° C, pH=5.5. (Cf. M. Sémériva, loc. cit.).

For purposes of the present invention, the lipase activity is given in LCA units, but measured at pH 9.5. According to the invention the lipases are added such that at pH 9.5 a lipase activity of 100–10,000 LCA, preferably 2000 to 4000 LCA, per kg of hide is present in the soaking and defatting bath.

The use in the soak of proteases which have a sufficient proteolytic efficacy in the pH reqion between 9 and 11 is known per se (Cf. U.S. 4,344,762). These are neutral (E.C. 3.4.24) and, particularly, alkaline proteases (E.C.3.4.21}[Cf. Kirk-Othmer, Encyclopedia of Chemical Technology, 3rd Edition, Vol. 9, pp 199–202, J. Wiley 1980; Ullmanns Encyclopädie der technischen Chemie, Vol. A9, pp. 409–414, Verlag Chemie, Weinheim 1987; L. Keay in "Process Biochemistry" 17–21 (1971)]. In detail they are:

Alkaline proteases which develop their activity optimum about in the region of pH 8–13. To this group belong alkaline bacterial proteases which mostly are of the serine type, and alkaline fungal proteases. Above all, the proteases from Bacillus strains should be mentioned, such as *B. subtilis, B. lichenformis, B. firmus, B. alcalophilus, B. polymixa, B. mesentericus*, also Streptomyces strains such as *S. alcalophilus*. The most advantageous working temperature with alkaline bacterial proteases is generally at 40° C.-60° C., but with fungal proteases rather at 20° C.-40° C. As alkaline fungal proteases are mentioned those from Aspergillus strains such as *A. oryzae*, from Penicillin strains such as *P. cyanofulvum*, or from *Paecilomyces persicinus*, inter alia. The activity of the fungal proteases is predominantly in the pH region 8.0-11.0. As a rule of thumb, one can assume an enzyme activity which is between 8000 and 10,000 Löhlein-Volhard Units [LVU] per gram;

Neutral proteases having an activity optimum in the region from pH 6.0-9.0. To this group particularly belong the bacterial proteases which as a rule belong to the metalloenzymes, and fungal proteases, for example neutral Bacillus proteases such as *B. subtilis. B. natto*, and *B. polymixa*; Pseudomonas proteases; Streptomyces proteases; and Aspergillus proteases from *A. oryzae, A. parasiticus*, and *Penicillium glaucum*. Neutral bacterial proteases develop their optimum activity at working temperatures from 20° C.-50° C., in contrast to the most advantageous temperature for neutral fungal proteases at 35° C.-40° C.

The proteolytic activity of the enzyme is usually determined according to the Anson hemoglobin method (M. L. Anson, J. Gen. Physiol., 22, 79 (1939)) or according to the Löhlein-Volhard method [modified according to the Verband der Textil-, Gerberie- und Wasschrohstuff-Hersteller (TEGEWA) in Leder, 22, 121-126 (1971)]. Accordingly, one Löhlein-Volhard Unit (LVU) corresponds to that amount of enzyme which under the test conditions (1 hour, 37° C.) evokes, in 20 ml of casein filtrate, an increase in hydrolysis product equivalent to 5.75 ($10^{-3}$) ml of 0.1 n NaOH. The protease activity in general is between 1000 and 60,000 LVU per kg of hide, preferably between 2000 and 14,000 LVU per kg of hide.

According to the activity, protease amounts between 0.05 to 0.8 percent by weight, as a rule of thumb about 0.1-0.25 percent by weight, calculated on the weight of the hides and skins used, are sufficient in the method of the invention. In the soaking method of the invention, additives known in the art, such as activators, stabilizers, and optional buffer substances, can also be added to the soaking float.

As (synthetic) surface active substances, conventional emulsifiers can be used, for example, particularly those which serve to emulsify fat in water. (Cf. British patent 586,540, German patent 894,142, French patent 899,983, French patent 918,523). Nonionic emulsifiers are most suitable, for example of the following kinds:

| I. Polyglycol derivatives (exemplary commercial products in parentheses) | |
|---|---|
| α) fatty acid polyglycols | ("EMULPHOR") |
| β) fatty alcohol polyglycol ethers | ("DEHYDOL") |
| γ) alkylphenol polyglycol ethers | ("EUMULGIN 286"; "FLUIDOL W 100"; "MARLOPHEN"; "IGEPAL) |
| δ) fatty acid ethanolamide polyglycol ethers | ("C"; "FORYL KW"; "EMULGIN") |
| II. Glycerine derivatives | |
| α) fatty acid monoglycerides | ("TEGOMOLS") |
| β) fatty acid polyglycerine esters | |

-continued

Further, anionic emulsifiers of the following types are suitable, for example:

| III. Sulfates R—$OSO_3Na$ | |
|---|---|
| α) fatty alcohol sulfates, primary and secondary | ("EPPOL DL conc.", "PERAMIT ML"; "TEEPOL") |
| β) fatty alcohol ether sulfates | ("TEXAPON Q") |
| γ) monoglyceride sulfates | ("VEL") |
| δ) Sulfation products of unsaturated oils and fatty acids | ("LEDEROLINOR DKMS") |
| IV. Sulfonates | |
| α) alkylbenzene sulfonates | ("MARLOPON"; "MARLON") |
| β) alkyl sulfonates | ("MERSOLAT") |
| γ) fatty acid condensation products | ("IGEPONA"; IGEPONT") |
| δ) petroleum sulfonates | (contained in "GRASSAN B") |
| ε) sulfited unsaturated fatty oils and fatty acids | ("CUTISAN BS") |
| φ) short chain alkylbenzene sulfonates, e.g. of cumene, toluene, or xylene. | |

Cationic emulsifiers are less advantageous, for example of the types:

V. Amine salts $RNR_1$, $R_2Hx$ ("SAPAMIN"; "SOROMIN")

VI. Quarternary ammonium salts

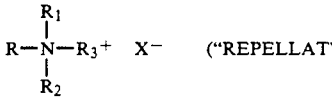

("REPELLAT")

α) ammonium salts

β) pyridinium salts, wherein principally the group R is a long chain alkyl group having 8-24 carbon atoms and the groups $R_1$, $R_2$ or $R_3$ as a rule signify short chain alkyl groups having up to 6 C-atoms.

The emulsifiers usable according to the invention have an HLB value (O/W emulsions) of 8-18, preferably 9-15, particularly 12-15. (Cf. Ullmanns Encyclopädie der techn. Chemie, 4th Edition, Vol. 10). Combinations of emulsifiers can also be used to advantage, particularly of nonionic and anionic emulsifiers. Ethoxylated alkylphenols (alkylphenol polyglycols) having a degree of ethoxylation (EO) of 4 to 40, preferably with an EO of 6.5 to 12 per mol of nonylphenol, optionally combined with anionic emulsifiers.

The content of emulsifiers in the soak float is—depending on the kind—as a rule from 0.1 to 1 percent by weight calculated on the salted- or green- weight.

Further, component (C) of the soak float can contain known sequestering agents or chelating agents, (D). These serve to mask calcium which may be present by forming complexes therewith, analogous to the softening of water for washing. Otherwise, calcium tends to form difficultly soluble substances, so called "calcium soaps", with the hydrolysis products formed by the action of lipases. These substances can cause various difficulties in leather making, e.g. "calcium shadows".

The sequestering agents (D) are chosen from the group formed from the polyphosphates, phosphonates, and polycarboxylates; ethylene diamine tetraacetic acid (EDTA); nitrilotriacetic acid; and diethylene triaminopentaacetic acid. The content of sequestering agents in the soak float can be from 0 to 0.5 percent by weight, preferably 0.05 to 0.15 percent by weight.

As already discussed in the introduction, the soaking process serves in the beamhouse inter alia to free the hides from adhering blood and dirt and to remove the salt from salt cured hides.

Thus it can be advantageous first to perform a so called soil soak. For this, in general soaking with water at about 30° C. for a certain time, for example two hours, suffices.

As containers, the pertinent soaking vessels now used can be employed, for example mixer, drum, tanning machine, or paddle. (Cf. F. Stather in *Gerbereichemie und Gerbereitechnologie,* 4th edition, Akademie-Verlag, Berlin 1967). As a guide value, a float length of 200 percent is applicable.

The soaking process is in general assisted to advantage by mechanical agitation. The soak float of the soil soak is suitably discarded.

The pH value of the soak float is adjusted between 9 and 11 by the addition of alkalis, for example basic sodium or potassium compounds such as sodium hydroxide, potassium hydroxide, soda, potash, etc.

Usually the components (A), (B), and optionally the sequestering agent (D), are used in the amounts described above in powder form together with the mostly-liquid surface active agents (C) (in the form of detergents). However, it is certainly possible to use all the components in the form of aqueous or nonaqueous liquid formulations. In such formulations, the sequestering agent is present in water soluble form and the surface active agents, preferably of the nonionic type, serve as stabilizers.

The soak according to the invention—like the soil soak—is advantageously carried out in the vessels usually used for this purpose and with agitation. As a guide value when working in a tanning drum, about 4 rpm can be given. As a guide value for the temperature of the soak, 28° C.±5° C. is pertinent. The duration of the soak as a rule is several hours, e.g. 3–7 hours. 6 hours can be taken as a guide value. In general, the soak float is discarded on conclusion of the soak. Subsequent to the soak, the hides and skins can be worked up further in a known manner, for example conveyed to the liming operation (cf. H. J. Rehn and G. Reed, *Biotechnology,* Vol. 6b, 734, Verlag Chemie, Weinheim 1988). The float length of the soak float advantageously is 100–300 percent, calculated on the total weight of the hides and skins.Advantageous effects.

The soaking method of the invention meets the requirements of industry to a particular degree. Even in the case of raw materials having a strong content of natural fat, for example pigskins and sheepskins, an outstanding softening and defatting effect is observed. The defatting values are, according to the results obtained so far, from 40 to 60 percent higher than those reached without the use of alkaline lipases. Unexpectedly, the necessary amount of proteases (B) can be reduced by the use of the alkaline lipases of component (A). If no proteases are used, then the defatting effect is decreased. If the emulsifiers of component (C) are omitted, then the defatting effect decreases drastically.

A better understanding of the present invention and of its many advantages will be had by referring to the following Examples, given by way of illustration.

EXAMPLES

1. Formulation examples

Test products a–h are shown in following Table 1 with respect to their contents of the components (A), (B), and (D).

The numerical values given are parts by weight of the components in the respective test products.

| | | Test Products | | | | | | | |
|---|---|---|---|---|---|---|---|---|---|
| | Components | a | b | c | d | e | f | g | h |
| B | alkaline protease (120,000 LVE/g at pH 9.5) | 1.5 | — | 1.5 | 3 | 1.5 | 1.5 | 1.5 | 1.5 |
| A | lipase (39,000 LCA/g at pH 9.5) | 3 | 3 | — | 3 | 3 | 3 | 3 | 3 |
| D | Na-tripolyphosphate | 30 | 30 | 30 | 30 | | | | |
| D | Na-polycarboxylate copolymer Mw = 2200 | | | | | | 20 | | |
| D | Na-salt of 1,1-hydroxyethane-diphosphonic acid | | | | | | | 10 | |
| D | EDTA | | | | | | | | 7 |
| | sodium sulfate to 100% | | | | | | | | |

2. Examples of industrial use

Example 2.1

10 kg of salted cowhides Class II, 30/39 kg

Soil soak (in a drum):

200.0 percent of water, 26° C.

Let run for 1 hour.

Discard float.

Main soak and defatting:

150 percent of water 0.3 percent of test product a–h 0.3 percent of standard emulsifier comprising 70 percent by weight of nonylphenol ethoxylate, 8–9 mols of ethylene oxide, and 30 percent by weight of the Na salt of a $C_{12}$–$C_{18}$-fatty alcohol ether sulfate with 2 mols of ethylene oxide 0.5 percent of sodium hydroxide, 33 percent to give pH 9.5–10.5. Agitate for 6 hours in a drum at 4 rpm; subsequent liming with conventional industrial lime-sulfide. Discard the float.

A test sample was taken from the float and the fat content determined. The quality of the soaking effect was determined from the rapidity of water uptake (rehydration), the degree of fiber separation, the cleansing of ground, and the grain draw of the dehaired hides, and graded with 1 (very good) to 6 (unsatisfactory).

EXAMPLE 2.2

10 kg of salted pigskins

Soil soak:

As in Example 2.1

Main soak:

150 percent of water, 30° C.

0.3 percent of test product a–h 0.6 percent of sodium hydroxide, 33%, to give pH 9.5–10.5

0.3 percent of standard emulsifier (cf. Example 2.1)

Agitate for 6 hours.

Discard float.

Determine flat in the soak float.

This is followed by conventional industrial liming and tanning.

Results of the practical tests

| Test Product | Ex. No. | Emulsifier* | Fat (g/l) in float | Soaking effect 1 = very good 6 = insufficient |
|---|---|---|---|---|
| a | 2.1 | Standard; 0.3% | 3.5 | 1–2 |
| b | 2.1 | " | 2.2 | 3–4 |
| c | 2.1 | " | 2.98 | 2 |
| d | 2.1 | " | 3.6 | 1–2 |
| e | 2.1 | " | 2.5 | 2–3 |
| f | 2.1 | " | 3.25 | 2–3 |
| g | 2.1 | " | 3.1 | 3+ |
| h | 2.1 | " | 3.0 | 3 |
| — | 2.1 | No emulsifier | 1.2 | 4–5 |
| — | 2.1 | Standard; 0.3% | 2.05 | 3–4 |
| a | 2.2 | " | 14.25 | 2 |
| b | 2.2 | " | 8.3 | 2–4 |
| c | 2.2 | " | 10.8 | 3–4 |
| — | 2.2 | " | 7.2 | 4 |
| — | 2.2 | — | 3.1 | 4–5 |
| a | 2.2 | docecyl benzene sulfonate, 0.3% | 11.3 | 3+ |

-continued

Results of the practical tests

| Test Product | Ex. No. | Emulsifier* | Fat (g/l) in float | Soaking effect 1 = very good 6 = insufficient |
|---|---|---|---|---|
| a | 2.2 | Na lauryl sulfonate, 0.3% | 10.8 | 2–3 |
| a | 2.2 | Mixture** | 15.5 | 2–3 |

*The Standard emulsifier is that of Example 2.1

**Consisting of: 70 wt. % of nonylphenol with 8–9 mol EO and 30 wt. % of $C_{8-18}$-alkyl trimethyl ammonium chloride.

Equally good results are obtained using, as sequestering agents, hexametaphosphoric acid, tannic acid, citric acid, gluconic acid, 5-sulfosalicylic acid, nitrilotrimethylene phosphonic acid, ethylenediaminetetramethylene phosphonic acid, or hydroxyethylidene diphosphonic acid instead of those reported as D in the Table on page 11.

What is claimed is:

1. A method for soaking hides and skins which comprising soaking said skins and hides in a soak float having a pH from 9 to 11 and comprising (A) a lipase having an activity optimum in the pH region from 9 to 11, (B) a protease which is effective in the pH region from 9 to 11, and (C) a surface active agent.

2. A method as in claim 1 wherein said protease (B) is an alkaline protease having an activity optimum in the pH region from 8 to 13.

3. A method as in claim 1 wherein said soak float additionally contains a sequestering agent.

4. A method as in claim 2 wherein said soak float additionally contains a sequestering agent.

* * * * *